US006170099B1

(12) United States Patent
Cheng

(10) Patent No.: US 6,170,099 B1
(45) Date of Patent: Jan. 9, 2001

(54) STRUCTURE OF A FOLDABLE BABY BED BASE

(75) Inventor: Ying-Hsiung Cheng, Tainan Hsien (TW)

(73) Assignee: Pao-Hsien Cheng, Tainan Hsien (TW)

( * ) Notice: Under 35 U.S.C. 154(b), the term of this patent shall be extended for 0 days.

(21) Appl. No.: 09/356,368

(22) Filed: Jul. 19, 1999

(51) Int. Cl.[7] ..... A47D 13/06
(52) U.S. Cl. ..... 5/99.1; 5/93.1
(58) Field of Search ..... 5/93.1, 98.1, 99.1, 5/174, 178, 179, 180, 202, 250, 658

(56) References Cited

U.S. PATENT DOCUMENTS

| | | | | |
|---|---|---|---|---|
| 5,279,006 | * | 1/1994 | Teng | 5/99.1 |
| 5,381,570 | * | 1/1995 | Cheng | 5/99.1 |
| 5,483,710 | * | 1/1996 | Chan | 5/99.1 |
| 5,890,263 | * | 4/1999 | Wu | 5/99.1 |
| 5,970,540 | * | 10/1999 | Cheng | 5/99.1 |

* cited by examiner

*Primary Examiner*—Terry Lee Melius
*Assistant Examiner*—Fredrick Conley
(74) *Attorney, Agent, or Firm*—Rosenberg, Klein & Lee

(57) ABSTRACT

A base of a foldable baby bed base comprises a middle member, two pivotal rods, two turning members and four connecting rods; middle parts of the pivotal rods are pivoted to the middle member; inner ends of the pivotal rods are pivoted to each other, and are biased downwardly by springs; a belt is connected to the inner ends of the pivotal rods such that pivotal rods can be pivoted on the middle member by pulling the belt; the turning members are connected to two outer ends of the middle member with rod parts thereof turnably received in outer end holes of the middle member; the rod parts each has stopping elements opposing each other; the upper ones of the stopping elements are located adjacent to end walls of the middle member for the rod parts to be stopped from turning inwardly; the lower ones of the stopping elements are located in curved recesses at outer ends of the pivotal rods to prevent the rod parts from turning outwardly unless the pivotal rods are pivoted for the curved recesses thereof to be separated from the lower stopping elements; the connecting rods are pivoted to the turning members for the bed to be foldable.

2 Claims, 10 Drawing Sheets

STRUCTURE OF A FOLDABLE BABY BED BASE

BACKGROUND OF THE INVENTION

The present invention relates to a base of a foldable baby bed, which an be folded to a smaller size when not in use.

A heretofore known foldable bed base, referring to FIGS. 9 and 10, comprises a connecting rod combination 9, supporting members 10 and movable members 20 as the main parts.

The connecting rod combination 9 consists of straight rods 91 and bent rods 92. The straight rods 91 are respectively pivoted to the bent rods 92. The rods 91 and 92 each has an elongated hole 911, 921 at inner ends thereof. Stationary supports 94 are connected to the rods 91 and 92 for supporting them at the position where the rods 91 and 92 are pivoted to each other. The stationary supports 94 each has a curved recess 941 for the corresponding bent rod 92 to be located thereon, and a through hole 942 for receiving a bolt used to pivot the rods 91 to the coresponding rod 92. Each of the stationary supports 94 further has a supporting leg 943.

Each of inner ends of the rods 91 and 92 is connected with a connecting member 93; the connecting members 93 each has a tube part 931 having a through hole 932, and a connecting tube 933 having a sloped locating surface 934 and a through hole 935.

The supporting members 10 each has two opposing gaps 101, a hole 102, a supporting leg 105 and a locating trench 106. The supporting legs 105 are arranged under the transverse rods 104; holes 107 are provided on the transverse rods 104 into order for a bolt 108 to pass therethrough to pivot one of transverse rods to the other.

The movable members 20 each has a C-shaped gap 201 at one end, and a platform portion 202 at the opposing end; the platform portions 202 each has a supporting leg 203 thereunder.

In combination, the connecting plate parts 933 of the connecting members 93 are passed into and, by means of a bolt, pivoted to a respective one of the gaps 101 of the supporting members 10. The inner ends of the rods 91, 92 are each passed into a respective one of the connecting members 93. A bolt for a pivotal connection pivots the through hole 932 and the elongated hole 921.

A bolt 108 is passed through the through holes 107 of the transverse rods 104 for pivotally connecting the transverse rods 104; washers 109, 100 are used on the holes 107 before the bolt 108 is passed into the holes 107. Furthermore, the movable members 20 are pivoted to the supporting members 10 by connecting the C-shaped gaps 201 to a respective one of the annular recesses 103 of the supporting members 10.

However, it can be seen that the base of the foldable bed has too many components, making the structure very complicated, and the assembling relatively labor-costing.

SUMMARY

Therefore, it is a main object of the present invention to provide a base of a foldable baby bed which has relatively few components and can be assembled very easily in order for the manufacturing cost to become lower than the prior art one.

The base of a foldable baby bed of the present invention comprises:

a connecting rod combination consisting of four connecting rods;

a middle member having a supporting pole, two hollows at two sides of the supporting pole, second connecting protrusions at two ends of the middle member, and first connecting protrusions between the hollows and the second connecting protrusions; springs being received in the hollow;

a first pivotal rod having a curved recess at an outer end thereof; the first pivotal rod being pivoted to one of the first connecting protrusions from a middle part thereof; the first pivotal rod further having a locating block at an inner end, passed into the corresponding one of springs in the hollows;

a second pivotal rod having a curved recess at an outer end thereof; the second pivotal rod being pivoted to the other first connecting protrusions from a middle part, and being biased downwards by the other spring of the hollow at an inner end; the inner end of the first pivotal rod being pivoted to the inner end of the second pivotal rod, and connected with a belt such that the inner end of the rods can be lifted to pivot the rods by pulling the belt;

two turning members each having a rod part pivot a respective one of the second connecting protrusions; the connecting rods being pivoted to the turning members; the rod parts each having two stopping elements opposing each other; the upper ones of the stopping elements are located adjacent to a wall of the middle member between the second connecting protrusions to stop the rod parts from turning inwardly; the lower ones of the stopping elements being each located in a respective one of curved recesses on the outer ends of the first and the second rods when the belt is not pulled, stopping the rod parts of the turning members from turning when the foldable bed is stretched to an in-use position.

It can be seen that the base of a foldable bed of the present invention has relatively few components, and can be assembled with less labor than the prior art one.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
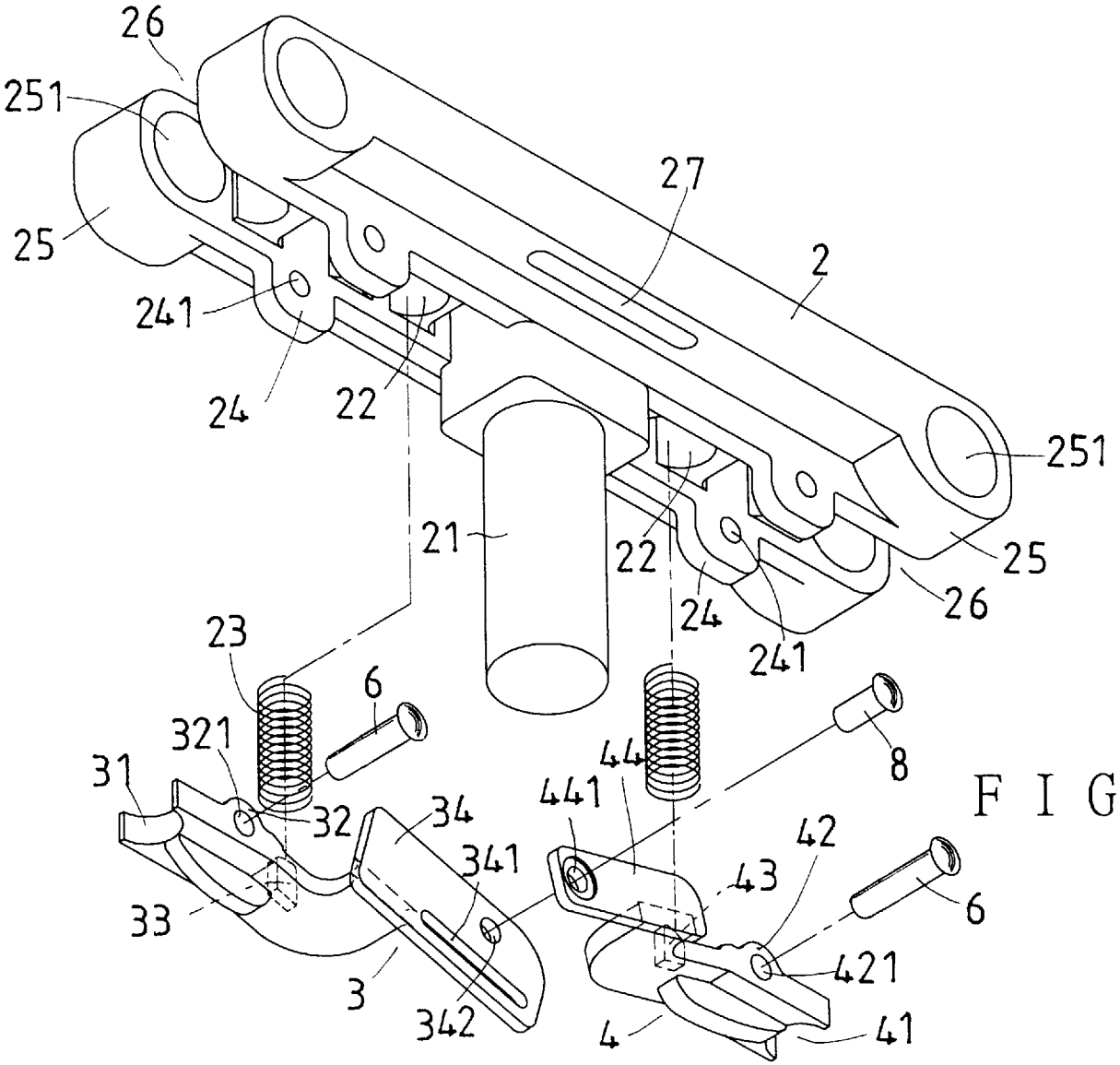
FIG. 1 is a fragmentary exploded perspective view of a base of a foldable baby bed according to the present invention.
Figure 2:
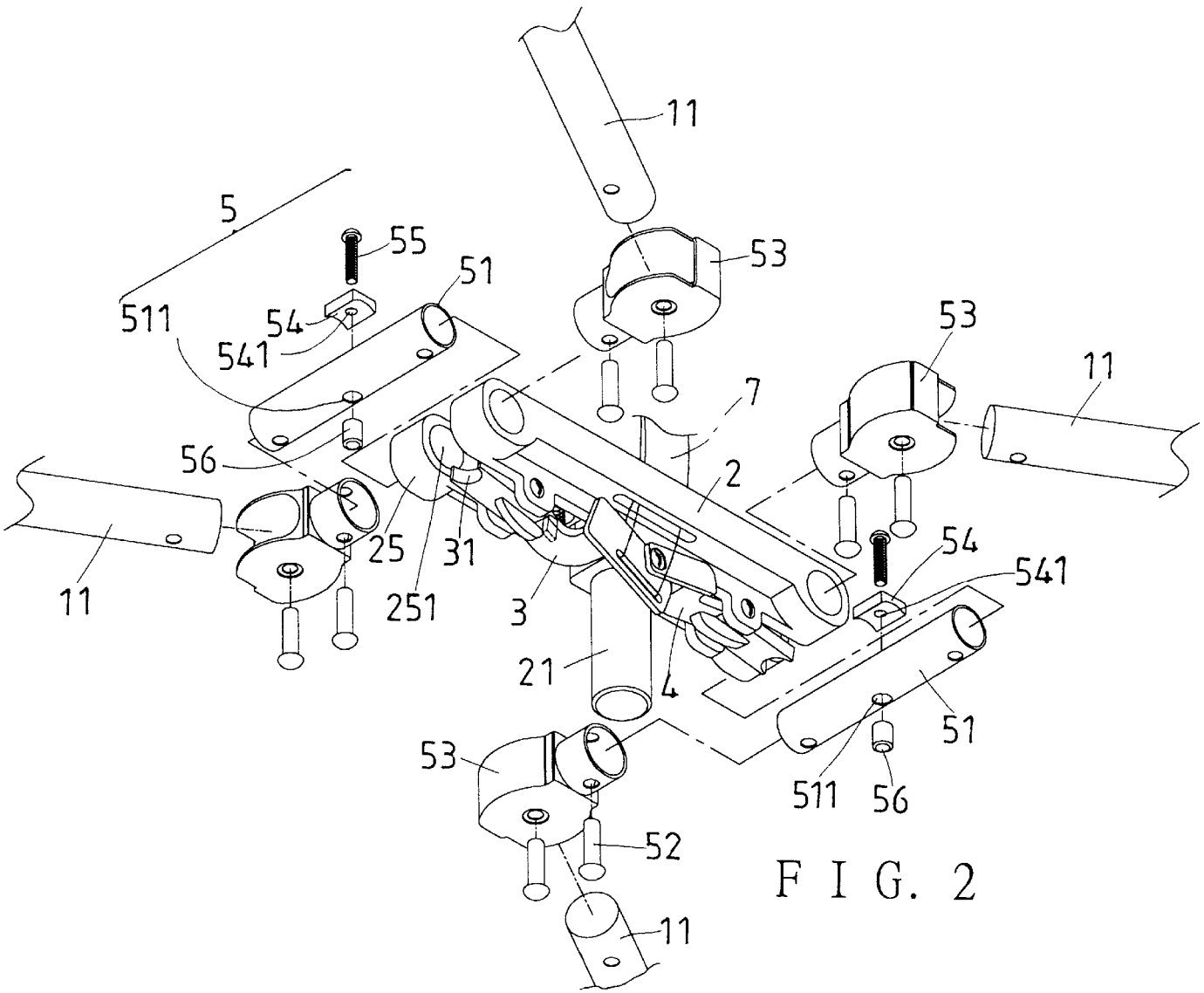
FIG. 2 is an exploded perspective view of the base of a foldable baby bed of the present invention.
Figure 3:
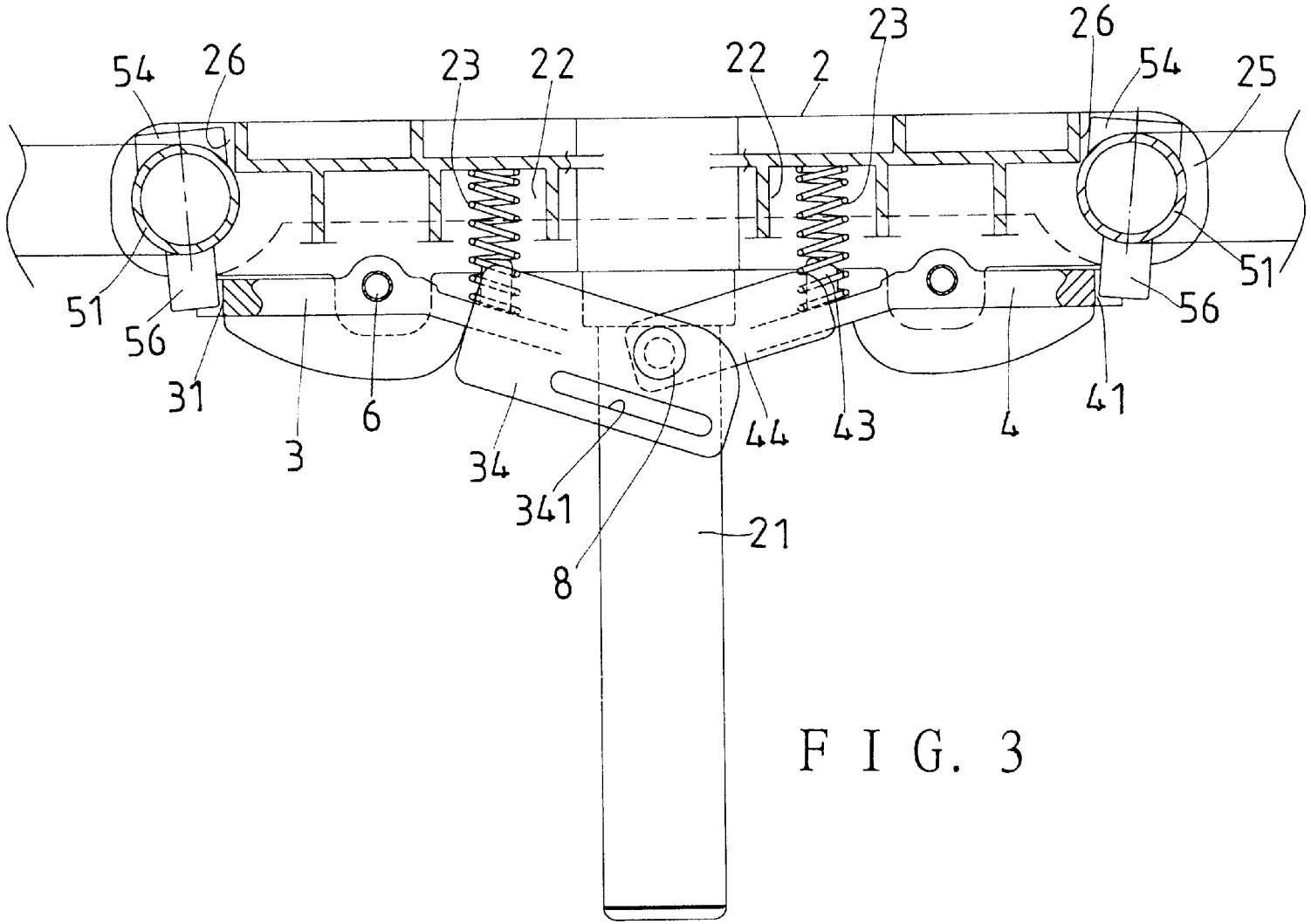
FIG. 3 is a cross-sectional view of the base of a foldable baby bed of the present invention.
Figure 4:
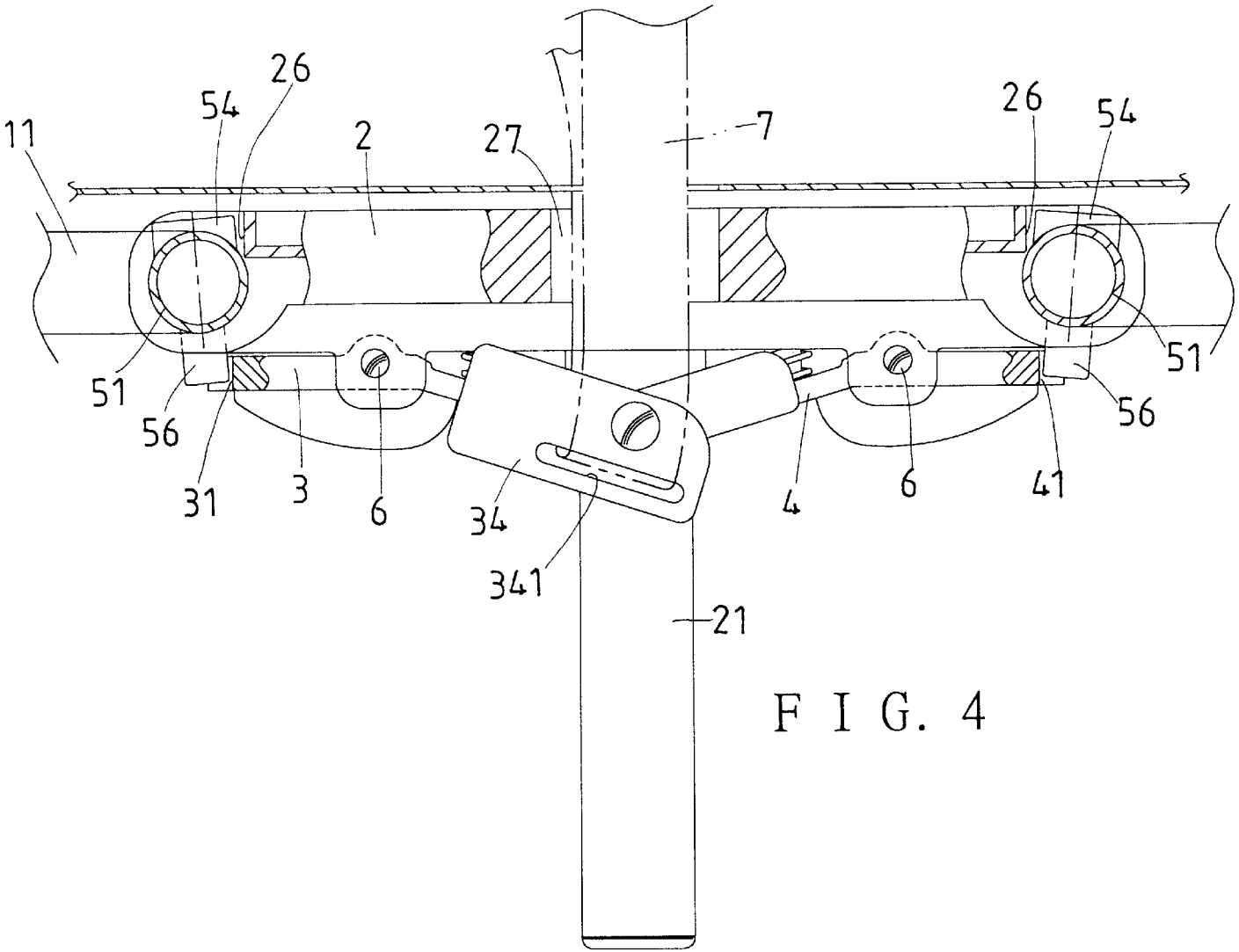
FIG. 4 is a side view of the base of a foldable baby bed of the present invention.
Figure 5:
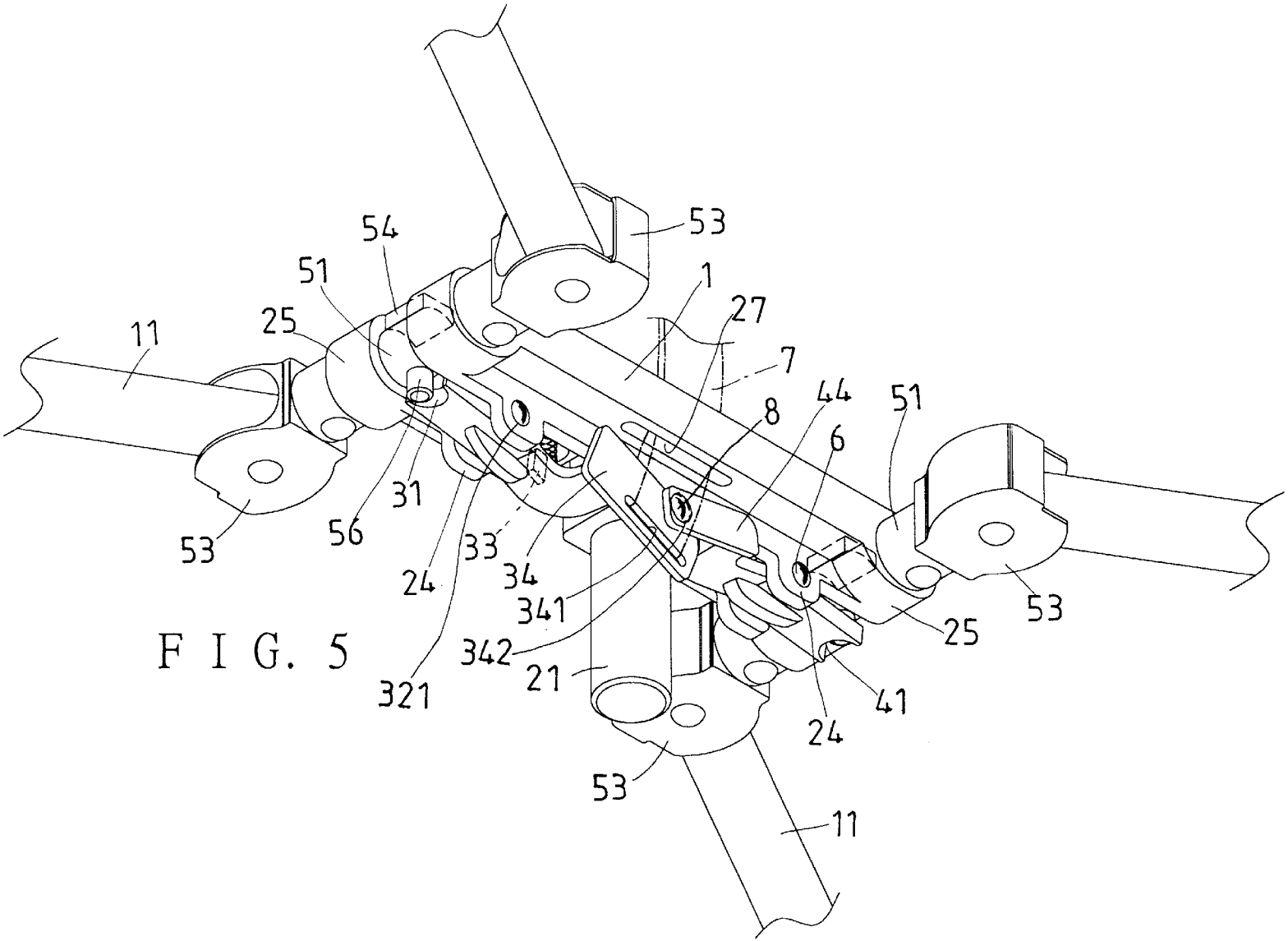
FIG. 5 is another cross-sectional view of the base of a foldable baby bed of the present invention.
Figure 8:
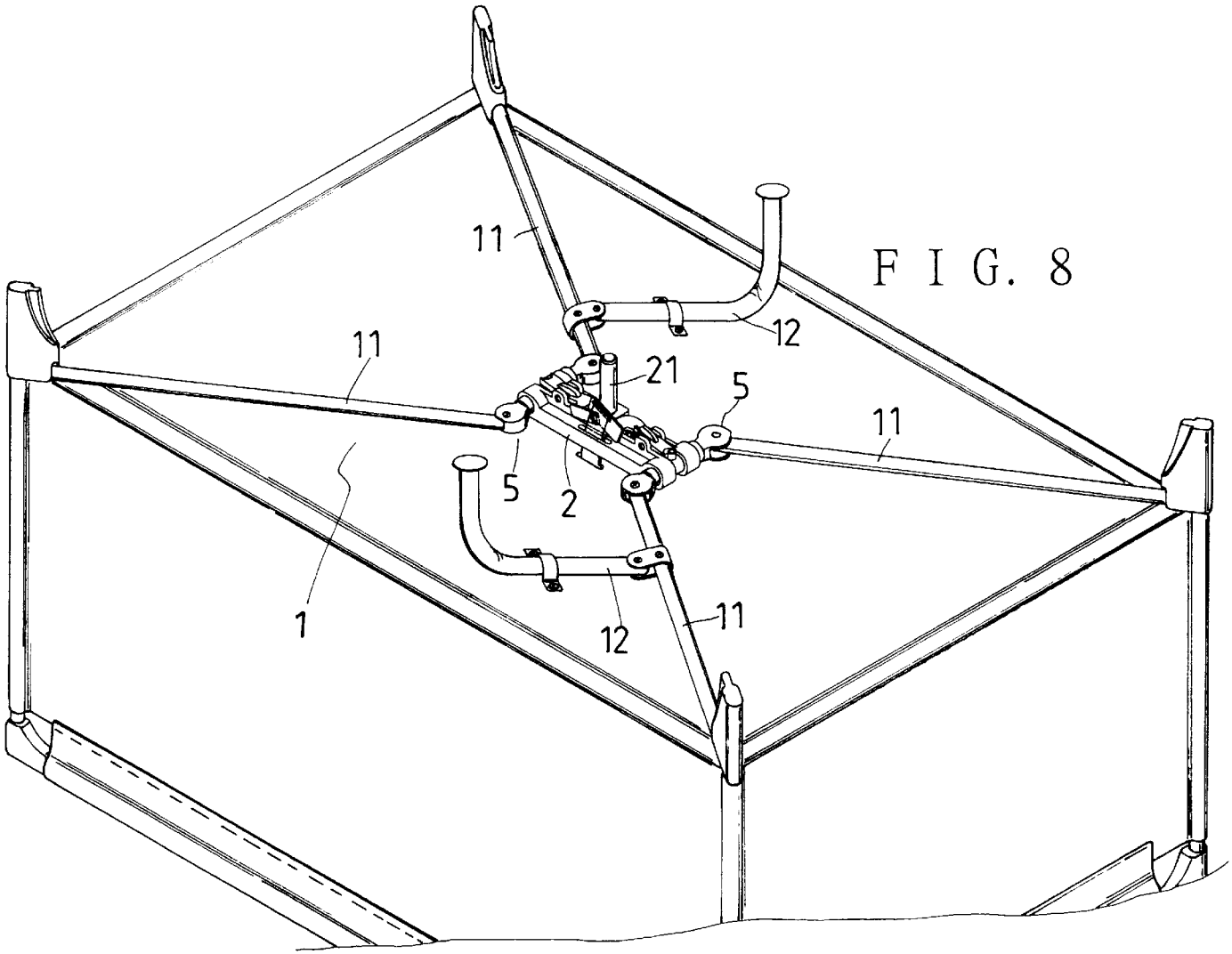
FIG. 8 is a veiw of the foldable baby bed according to the present invention.
Figure 9:
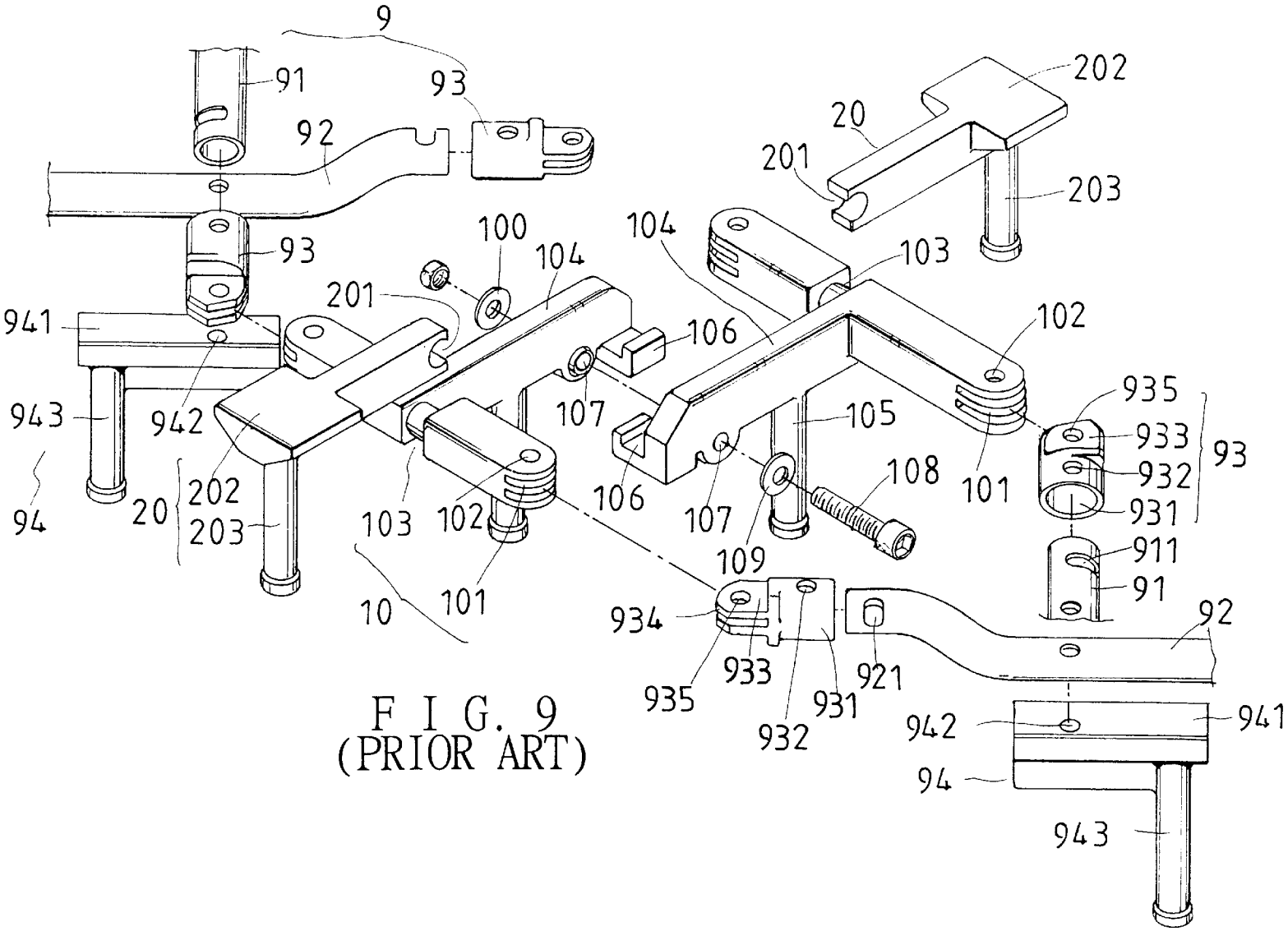
FIG. 9 (PRIOR ART)
FIG. 9 is an exploded view of a prior art base of a foldable baby bed as described in the Background.
Figure 10:
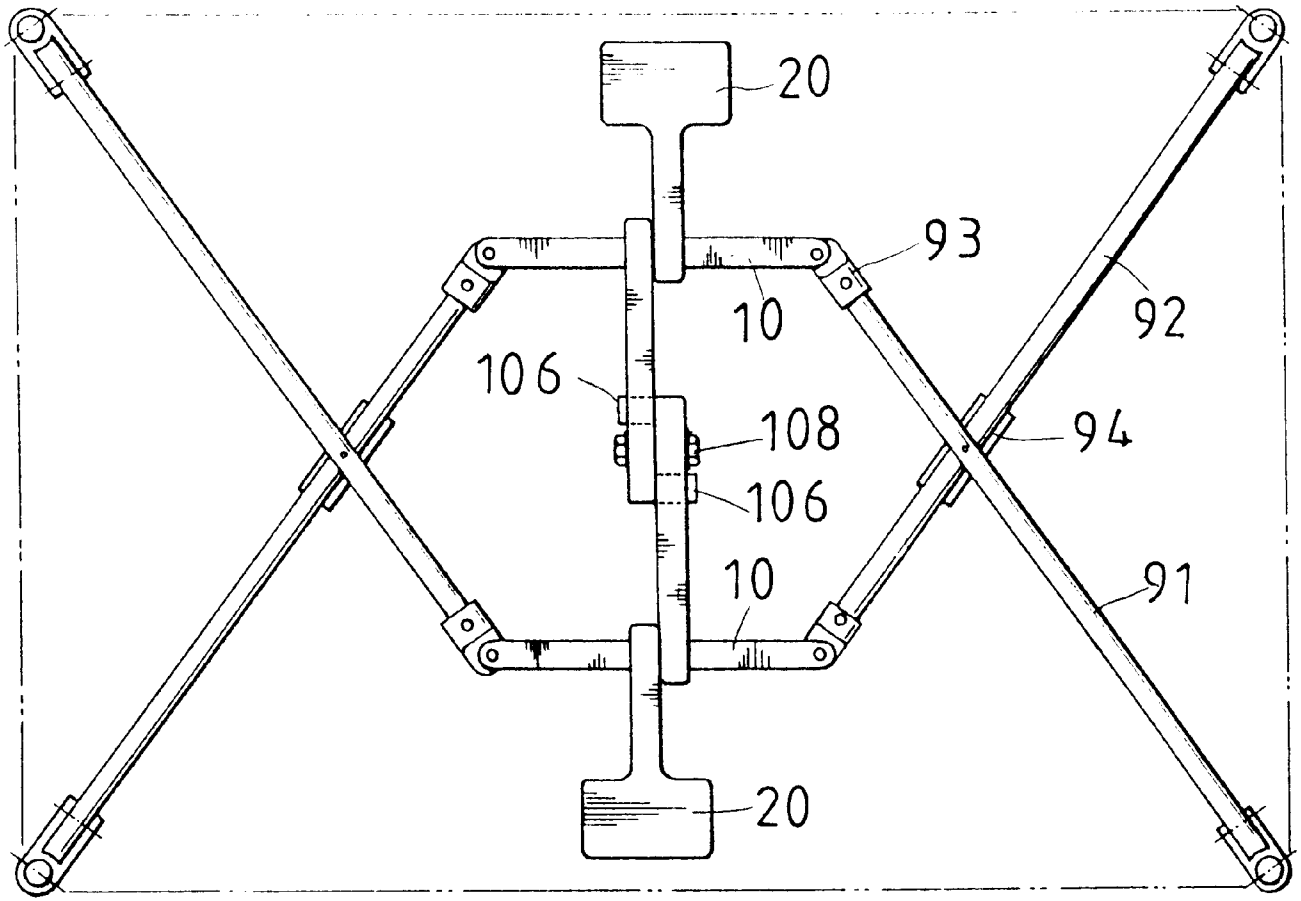
FIG. 10 (PRIOR ART)
FIG. 10 is a top view of the prior art base of a foldable baby bed.

A base of a foldable baby bed of the present invention, referring to FIGS. 1,2 and 8, comprises a connecting combination 1, a middle member 2, a first pivotal rod 3, a second pivotal rod 4 and two turning members 5 as the main parts.

The connecting rod combination 1 includes four connecting rods 11 and two supporting rods 12 each connected to a connecting rod 11 in an opposite position. The supporting rods 12 are provided for supporting the bed base from the ground.

The middle part 2 has a supporting pole 21, two hollows 22 at two sides of the supporting pole 21, first connecting protrusions 24, and second connecting protrusions 25 at outer ends thereof. The hollows 22 each has a spring 23 received therein. The supporting pole 21 is provided for supporting the bed base from the ground. Each of the first and the second connecting protrusions 24 and 25 has a through hole 241, 251. The middle part 2 further has an elongated hole 27. Gaps 26 are formed between the adjacent ones of the connecting protrusions 25 of the middle part. Each of the gaps 26 has a wall (not numbered).

Referring specifically to FIG. 1, the first pivotal rod 3 has a curved recess 31 at outer end thereof, and has two connecting protrusions 32 opposing each other at a middle portion thereof. Each of the connecting protrusions 32 has a through hole 321. The first pivotal rod 3 further has a locating block 33 and a plate part 34 having an elongated hole 341. A pivotal hole 342 is provided above the elongated hole 341 on the plate part 34.

The second pivotal rod 4 has a curved recess 41 at an outer end thereof, and has two connecting protrusions 42 opposing each other. Each of the connecting protrusions 42 has a through hole 421. The second pivotal rod further has a locating block 43, and a plate part 44 having a pivotal hole 441.

Referring specifically to FIG. 2, the turning members 5 each includes a rod part 51, two connecting parts 53, a stopping block 54 and a stopping element 56. Fixing elements 52 are used to connect two ends of the rod part 51 to the connecting parts 53. The stopping blocks 54 and the stopping elements 56 are fixed on two sides of the rod part 51 by means of fixing elements 55 past through a hole 541 of the stopping block 54, a through hole 511 of the rod part 51 and the stopping element 56.

In combination, the springs 23 are positioned in the hollows 22 of the middle part 2. The first pivotal rod 3 is pivoted to the middle part 2 by inserting a pivotal revet 6 into the through holes 321 of the first pivotal rod 3 and the through holes 241 of the first connecting protrusions 24 of the middle part 2 with the locating block 33 inserted into a lower end portion of the corresponding spring 23 of the middle part 2. The second pivotal rod 4 is pivoted to the middle part 2 by inserting another pivotal rivet 6 into the through holes 421 and 241 with the locating block 43 inserted into a lower end portion of the corresponding spring 23 in the middle part 2. Next, a pivotal rivet 8 is inserted into the pivotal holes 441 of the first and the second pivotal rods to pivot the second pivotal rod 4 to the first one 3. A belt 7 is passed through the elongated holes 27 and 341, and connected to the first pivotal rod 3 such that a user can pull the belt 7 to control the position of the first pivotal rod 3. Then, the rod parts 51 of the turning members 5 are inserted into the through holes 251 of the connecting protrusions 25 of the middle member 2 with the stopping blocks 54, and the stopping elements 56 located adjacent to the walls of the gaps 26 of the middle member 2, and the curved recesses 31,41 of the pivotal rods 3, 4 respectively. Then, the connecting parts 53 are connected to two ends of the rod parts 51 by means of the fixing elements 52. And, the connecting rods 11 of the connecting rod combination 1 are each pivoted to a corresponding one of the connecting parts 53.

When the foldable baby bed is stretched to an in-use position, the stopping blocks 54 and the stopping elements 56 contact the walls of the gaps 26, and the curved recesses 31, 41 of the pivotal rods 3, 4 respectively, prevent the rod parts 51 of the turning members 5 from turning, firmly locating the related parts in an unfolded in-use position.

Figure 6:
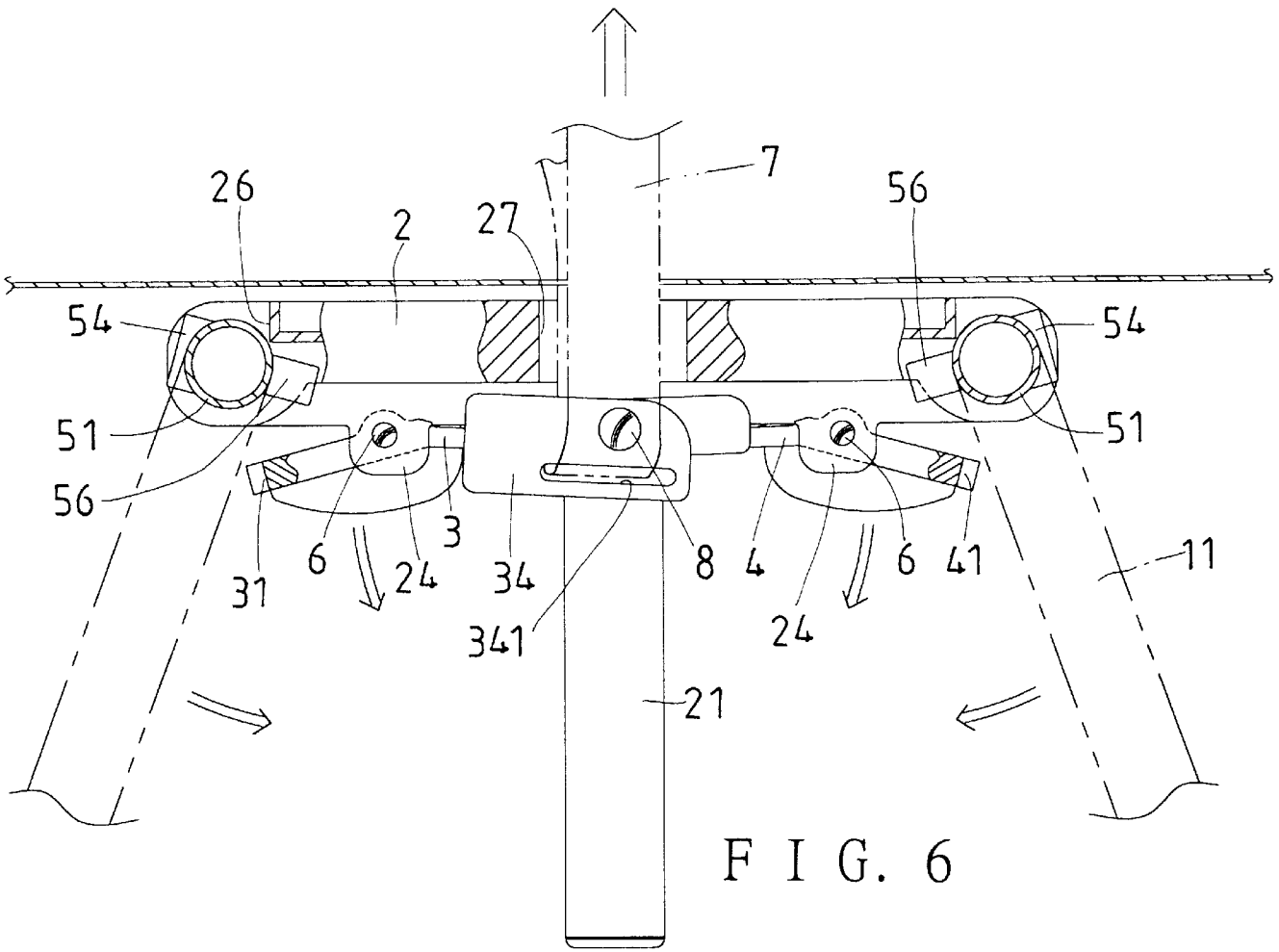
FIG. 6 is a view of the base of a foldable baby bed of the present invention, under the folding action.
Figure 7:
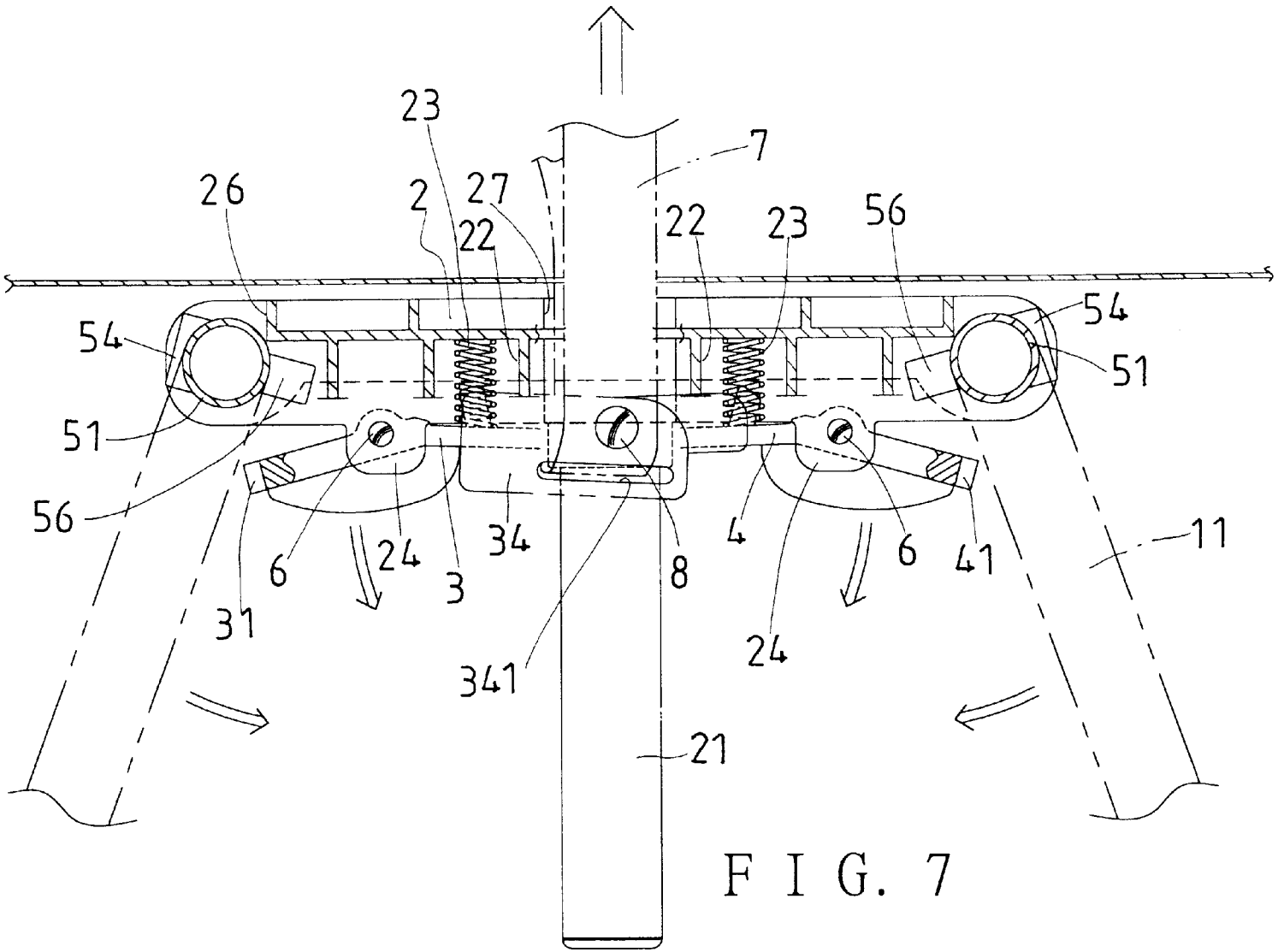
FIG. 7 is another view of the base of a foldable baby bed of the present invention, under the folding action.

To fold the bed from an in-use position to a folded not-in-use position, referring to FIGS. 6 and 7, the belt 7 is pulled upwards to pivot the pivotal rods 3 and 4 on the middle member 2, moving the curved recesses 31, 41 of the pivotal rods away from the stopping elements 56 of the turning members 5. Thus, the rod members 51 of the turning members 5 are no longer stopped from turning. Therefore, a user can turn the turning members 5, and pivot the connecting rods 11 on the turning members 5 to fold the baby bed. From the above description, it can be seen that the base of the foldable baby bed has advantages as follows.

1. The foldable bed can be folded and unfolded very easily.
2. The foldable bed base has fewer components than the prior art one. Therefore, the manufacturing cost is lower, and the assembling labor is less.
3. The stopping element and the stopping block of the turning member are stopped from moving by the curved recess, and the wall of the gap of the middle member, preventing the bed, after unfolded, from being unwarily folded.

What is claimed is:

1. A base of a foldable baby bed, comprising:

(a) a connecting rod combination consisting of four connecting rods;

(b) a middle member having a supporting pole, two hollows at two sides of said supporting pole, first connecting protrusions and second connecting protrusions; said hollows each having a spring received therein; said supporting pole being provided for supporting said base from a ground; said middle member further having an elongated hole;

(c) a first pivotal rod having a curved recess at an outer end thereof; said first pivotal rod having two opposing connecting protrusions at a middle portion, pivotted to one of said first connecting protrusions of said middle member; said first pivotal rod having a locating block at and opposite end of said curved recess, passed into one of said springs;

(d) a second pivotal rod hving a curved recess at an outer end thereof; said second pivotal rod having two opposing connecting protrusions at a middle portion, pivoted to other one of said second connecting protrusions of said middle member; said second pivotal rod having a locating block at an opposite end of said curved recess thereof, passed into other one of said springs; said second pivotal rod being pivoted to said first pivotal rod for permitting said second rod to be capable of pivoting with each other;

(e) a belt passed through said elongated hole of said middle member, and connected to said first pivotal rod for permitting said first rod to be pivoted on said connecting protrusion on pulling said belt;

(f) two turning members each having a rod part, and two connecting parts; said rod parts being through holes of a respective one of said second connecting protrusions of said middle member; said connecting parts being connected to two ends of said rod parts; said connecting rods of said connecting rod combination being each pivoted to a corresponding one of said connecting part; said rod parts each having a stopping block, adjacent to a wall of said middle member, and a stopping element opposing a corresponding one of said stopping block, said stopping elements being located adjacent to, and stopped by, said curved recesses of said pivotal rods when said bed is stretched to an unfolded in-use position for preventing said turning members from turning relative to said middle member, said wall stopping said stopping block from moving inwardly to prevent said rod parts of said turning member from turning inwardly, said turning members being capable of turned to fold said bed to a not-in-use position when said belt is pulled to pivot said first and said second pivotal rods on said middle member for said curved recesses to be moved away from, and no longer stop said stopping elements.

2. The base of a foldable baby bed as claimed in claim 1, wherein said connecting rod combination further has supporting rods each connected to a respective one of said connecting rods for supporting same from a ground.

* * * * *